US005820356A

United States Patent [19]

Ogbuaku

[11] Patent Number: 5,820,356

[45] Date of Patent: Oct. 13, 1998

[54] POWER STEERING PUMP APPARATUS

[75] Inventor: David Chukwuemeka Ogbuaku, Inkster, Mich.

[73] Assignee: Ford Global Technologies, Inc., Dearborn, Mich.

[21] Appl. No.: 534,426

[22] Filed: Sep. 27, 1995

[51] Int. Cl.[6] ..... F04B 39/16

[52] U.S. Cl. ..... 417/313; 210/167; 210/171

[58] Field of Search ..... 417/313; 418/47; 210/167, 171, 131, 168, 258, 445, 473, 474, 416.1, 416.5

[56] References Cited

U.S. PATENT DOCUMENTS

| | | | |
|---|---|---|---|
| 3,632,238 | 1/1972 | Searle . | |
| 3,751,191 | 8/1973 | Mott, Jr. et al. . | |
| 4,082,665 | 4/1978 | Schneider et al. . | |
| 4,454,717 | 6/1984 | Wade et al. . | |
| 4,517,083 | 5/1985 | Hayes et al. | 210/131 |
| 4,650,572 | 3/1987 | Hayes | 210/131 |
| 4,964,983 | 10/1990 | Abe et al. . | |
| 4,995,970 | 2/1991 | Ohsakai | 210/167 |
| 5,089,129 | 2/1992 | Brigman | 210/223 |
| 5,318,411 | 6/1994 | Heinrichs et al. . | |

*Primary Examiner*—Timothy Thorpe
*Assistant Examiner*—Peter G. Korytnyk
*Attorney, Agent, or Firm*—Gregory P. Brown

[57] ABSTRACT

An improved power steering pump integrates into a single assembly the pump (10), the reservoir (20) and a filtration system. The reservoir (20) includes upper and lower chambers (26, 24) and a primary filter (40) therebetween. The filtration system may also include a secondary filter (42) for providing filtration of fluid added through a filler device (31). The reservoir (20) may also include a bypass chamber (30) and a fluid bypass (66) with a bypass valve (68) for permitting fluid to bypass the primary filter (40) in the event the fluid exceeds a predetermined viscosity.

18 Claims, 2 Drawing Sheets

POWER STEERING PUMP APPARATUS

BACKGROUND OF THE INVENTION

1. Field of the Invention

This invention relates generally to power steering pumps for motor vehicles. More particularly, the present invention provides a power steering pump, reservoir and filter system in a single, space efficient assembly.

2. Disclosure Information

Power steering systems used in motor vehicles have employed fluid reservoirs and filtering systems to enhance the operation and durability of the power steering mechanism and pump for some time. Conventionally, these various components have been located remote from one another due to packaging constraints at the point of installation of the pump. As one of many engine driven accessories, the pump competes for space on the front end of the engine. To minimize the space required, hoses interconnect remotely disposed filters and reservoirs. It has been recognized that it would be more cost efficient, and less complex to provide a single assembly, including a pump, reservoir and filtering system that requires a minimum amount of space at the front end of an engine.

U.S. Pat. No. 3,632,238 discloses a pump, reservoir and filter combination. However, contaminants may still enter the fluid through the reservoir filler. Adding fluid through the filler may introduce contaminants into the fluid what may degrade the performance of any of the components downstream therefrom. Additionally, there is no disclosure of incorporating a provision for extreme cold weather operation. Modern power steering systems have benefited greatly by the incorporation of ultra fine filtration systems. However, during extreme cold weather operation, the fluid viscosity increases, reducing the flow rate through ultra fine filtration systems.

It would be desirable to provide a cost efficient, low complexity power steering pump, reservoir and filtration system in a single assembly capable of filtering all fluid entering the pump and any systems downstream therefrom. It would be further desirable for the assembly to provide ultra fine filtration and the capacity to provide the necessary flow rate during operation in extreme cold weather.

SUMMARY OF THE INVENTION

The present invention provides a fluid pump apparatus for use in a motor vehicle having the reservoir and filtration system integrated in a single, compact and cost efficient assembly. Thus reducing the number of hoses and fittings required and the additional complexity associated with these extra parts in the final assembly process.

The fluid pump apparatus of the present invention uniquely includes a pump housing having a fluid outlet with a reservoir attached to the pump housing. The reservoir has a lower chamber disposed adjacent to the housing and an upper chamber disposed above the lower chamber. The upper chamber includes a fluid inlet for receiving return fluid from the pump and steering system. The reservoir includes a filler device, disposed on the reservoir above the upper chamber for filling the reservoir with a fluid. A filter is disposed in a fluid path between the upper chamber and the lower chamber to filter the fluid flowing between the upper and lower chambers.

An advantage of this fluid pump apparatus is improved filtration of fluid entering the pump over a greater range of operating temperatures while providing reduced complexity over a similar systems having remote filtration and reservoir systems.

Other objects, features and advantages of the present invention will become apparent to those skilled in the art from the drawings, detailed description and claims which follow.

DETAILED DESCRIPTION OF THE PREFERRED EMBODIMENT

Figure 1:
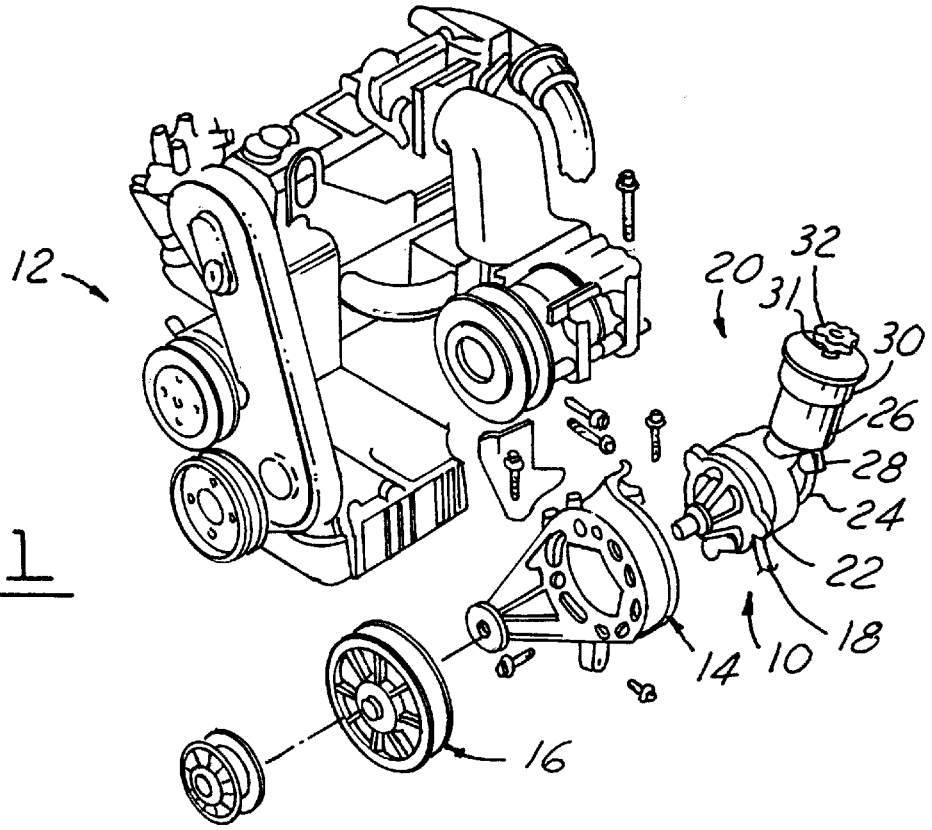
FIG. 1 is a partially exploded, perspective view of an engine for a motor vehicle having a fluid pump apparatus in accordance with the present invention.

Referring now to FIG. 1, a portion of a power steering system for a motor vehicle is shown. A pump 10 mounted to an engine 12 by a bracket 14 and driven by a pulley 16 includes a fluid outlet 18 communicating pressurized fluid by way of hoses and tubes to a known power steering unit (not shown). The pump 10 incorporates a reservoir 20 mounted directly to a pump housing 22. The reservoir 20 includes a lower chamber 24 attached to the housing 22, and upper chamber 26 disposed above the lower chamber 24 and including a fluid inlet 28 for receiving return fluid form the power steering unit. The reservoir 20 also includes a bypass chamber 30 disposed adjacent to the upper chamber 26 and a filler device 31 having a sealed filler cap 32 for allowing the addition of fluid to the reservoir 20.

Figure 2:
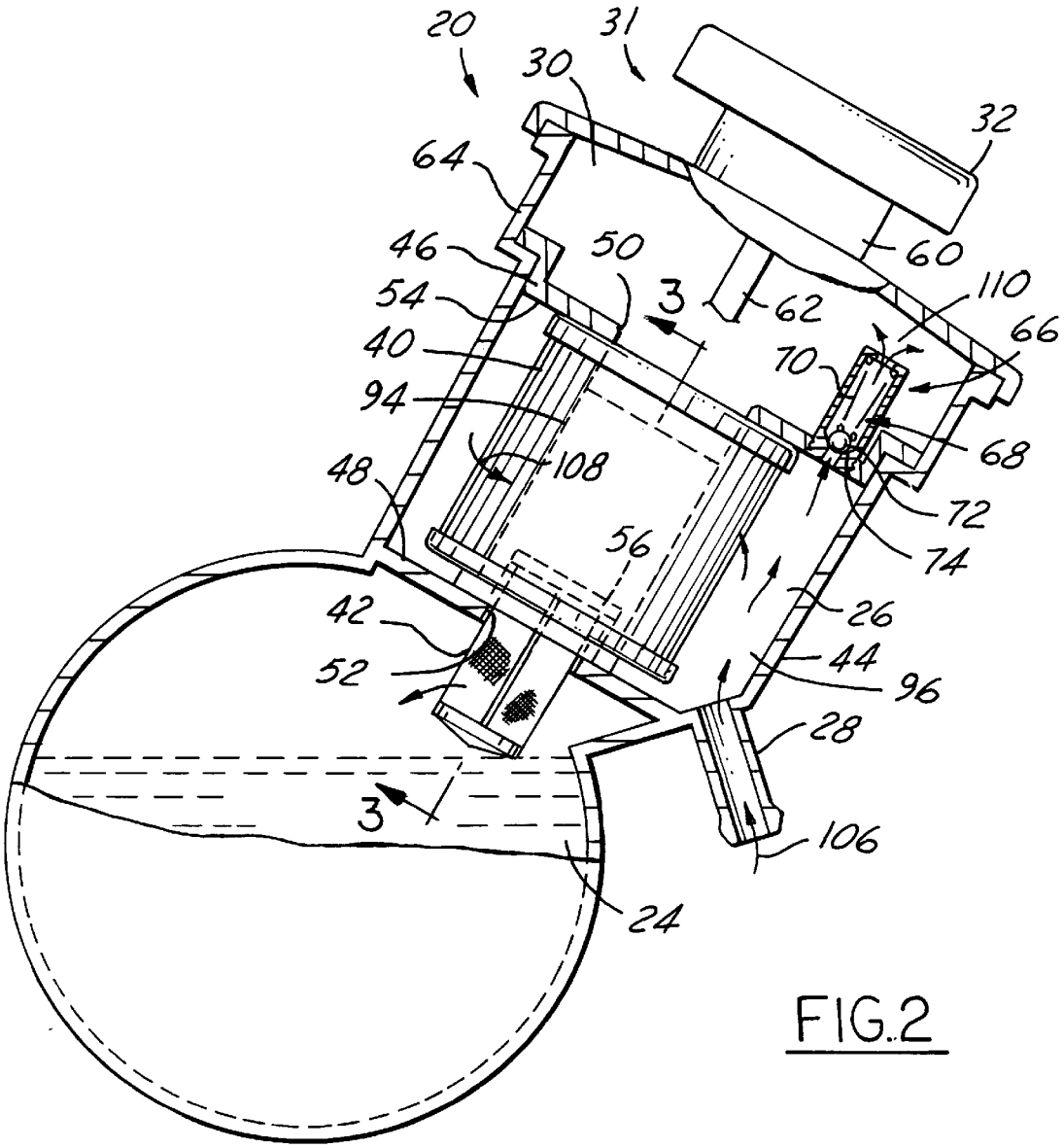
FIG. 2 is a partially sectioned, elevational view of a fluid pump having a reservoir and filtration system integrated in a single assembly in accordance with the present invention.

Referring now to FIG. 2, the reservoir 20 incorporating a filter system will be more completely described. In the presently preferred embodiment, the filter system includes primary and secondary filters 40, 42, which may be annular as illustrated. The lower chamber 24 receives filtered fluid 35 from the upper chamber 26.

The upper chamber 26 is defined by a lower cylindrical member 44 extending upward from the lower chamber 24. A first intermediate member 46 extends radially inward from the lower cylindrical member 44 to separate the upper chamber 26 from the bypass chamber 30. A second intermediate member 48 separates the upper and lower chambers 26, 24. The upper chamber 26 further includes a fluid inlet 28 for receiving fluid form the power steering unit.

The first and second intermediate members 46, 48 have first and second apertures 50, 52 therein, respectively, to allow fluid communication between the respective chambers. The first intermediate member 46 further includes a contact face 54 disposed on the side facing the upper chamber 26. The second intermediate member 46 also includes an annular flange 56 extending upward into the upper chamber 26.

The bypass chamber 30 includes a filler device 31 for adding fluid to the reservoir 20. In the preferred embodiment, the filler device 31 incorporates a well known filler neck 60 threaded to receive the fluid sealed filler cap 32, which may incorporate a dipstick 62 for checking the fluid level in the reservoir 20. The bypass chamber 30 includes an upper cylindrical member 64 which may be adapted to allow removal of the first intermediate member 46 to permit servicing of the primary and secondary filters 40, 42. In the presently preferred embodiment, the first intermediate member 46 is vibration welded permanently in place.

The bypass chamber also may include a fluid bypass 66 disposed on the first intermediate member 46. The fluid bypass 66 is adapted to permit, under certain conditions to be described more fully below, fluid communication from the upper chamber 26 into the bypass chamber 30. This communication path is unique form the first aperture 50 in that the fluid bypasses the primary filter 40. To ensure that this only occurs under certain predetermined operating conditions, a bypass valve 68 may be positioned in the fluid bypass 66. An exemplary valve would include a wound spring 70 for sealingly urging a check ball 72 against a chamfered ball seat 74.

Figure 3:
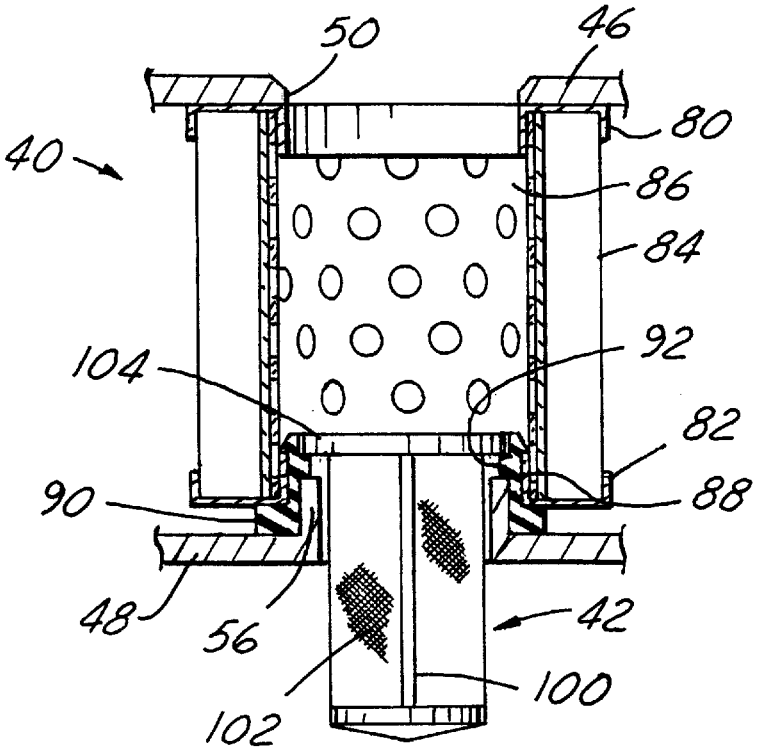
FIG. 3 is a partially sectioned, elevational view of a filtration system according to the present invention.

Referring now to FIGS. 2 and 3, the filtration system of the preferred embodiment will now be described. The primary filter 40 is a cylindrical filter and is annularly disposed within the upper chamber 26. The primary filter 40 includes upper and lower plates 80, 82 capping both ends of a pleated paper filter element 84. The inside of the pleated paper filter is bonded to a perforated metal tube 86 which extends between the upper and lower plates 80, 82. The lower plate 82 includes an elastomeric seal 88 bonded to an inner periphery thereof to form a sliding seal with the annular flange 56 of the second intermediate member 48.

The elastomeric seal 88 also includes a radial flange 90 which engages the second intermediate member 48 to urge the upper plate 80 of the primary filter 40 into a sealing engagement with the contact face 54 of the first intermediate member 46. The elastomeric seal also includes an inwardly projecting lip 92. Having formed seals at both the upper and lower plates 80, 82 the primary filter effectively divides the upper chamber 26 into an inner and outer portions 94, 96. The outer portion 96 receives unfiltered fluid returning from the power steering unit. This fluid cannot enter the inner portion of the upper chamber without either passing through the primary filter 40 or the fluid bypass 66 due to the sealed nature of the primary filter 40.

The secondary filter 42 is cylindrical and preferably annularly disposed within the primary filter 40 and includes a support structure 100 over which a cellulose mesh filter 102 may be disposed. The support structure 100 includes an upper flange 104 which sealingly engages the inwardly projecting lip 92 of the elastomeric seal 88. In the preferred embodiment, the paper filter 84 provides filtration of a substantially finer particulate than does the cellulose mesh filter 102. For example, the paper filter 84 may provide filtration of particulate down to 10 microns, whereas the cellulose filter 102 may only provide filtration of particulate down to 200 microns.

During normal operation, fluid 106 flows (indicated by arrows) into the reservoir 20 at the fluid inlet 28. The fluid level rises in the outer portion 96 of the upper chamber 26 and exits via a primary fluid path 108, where it is filtered through the primary filter 40 and passes into the inner portion of the upper chamber 94 and eventually into the lower chamber 24. The filtered fluid passes downward through the secondary filter 42 into the lower chamber 24 to be used by the pump 10. If the primary filter 40 is unable to flow sufficient fluid, for instance due to increased fluid viscosity, the outer portion 96 of the upper chamber 26 will fill completely, causing overflow fluid to follow a secondary fluid path 110 through the fluid bypass 66.

Fluid passing through the fluid bypass 66 enters the inner portion 94 of the upper chamber 26 through the first aperture 50. At this point, bypass flow is received in the inner portion 94 the same as new fluid added through the filler neck 60. This fluid passes directly to the secondary filter. The secondary filter captures any contaminants that may enter when refilling, as well as any large contaminants collected on the fluids previous pass through the system.

If the fluid bypass 66 includes the bypass valve 68, the frequency of fluid bypassing the primary filter can be controlled. For instance, if the bypass valve 68 opens only upon the fluid in the outer portion 96 attaining a predetermined pressure, then prior to the attainment of that pressure, the fluid will be pressure forced through the primary filter 40. In the preferred embodiment, the wound spring 70 has been selected to allow the bypass valve 68 to open when the fluid viscosity reaches a level corresponding to a fluid temperature of minus forty degrees Fahrenheit. The internal pressure corresponds to approximately ten pounds per square inch (psi). Operation of the vehicle will rapidly increase the temperature of the fluid, bringing a corresponding reduction in viscosity of the fluid and a return to normal fluid filtering through the primary filter. This bypass system permits the use of an ultra fine primary filter, which can significantly improve the operation of the pump and associated steering unit.

The foregoing description presents a single embodiment of the present invention. Details of construction have been shown and described for purposes of illustration rather than limitation. Modifications and alterations of the invention will no doubt occur to those skilled in the art that will come within the scope and spirit of the following claims.

We claim:

1. A fluid pump apparatus for use in a motor vehicle, said fluid pump apparatus comprising:

a pump housing having a fluid outlet;

a reservoir attached to said pump housing, said reservoir having a lower chamber disposed adjacent to said housing and an upper chamber disposed above said lower chamber and including a fluid inlet;

filler means disposed on said reservoir above said upper chamber for filling said reservoir with a fluid; and a filter disposed in a fluid path between said upper chamber and said lower chamber, said filter being operative to filter fluid flowing between said upper and lower chambers.

2. A fluid pump apparatus according to claim 1, wherein said filter further comprises:

a primary filter disposed within said upper chamber, said primary filter being adapted to filter fluid flowing in a primary path; and a secondary filter an fluid communication with fluid filtered by said primary filter and fluid flowing in a secondary fluid path.

3. A fluid pump apparatus according to claim 2, wherein said primary filter provides filtration of substantially finer particulate than said secondary filter.

4. A fluid pump apparatus according to claim 2, wherein said reservoir further comprises a bypass chamber disposed adjacent to said upper chamber and a bypass for communicating fluid form said inlet in said upper chamber into said bypass chamber without passing through said primary filter.

5. A fluid pump apparatus according to claim 4, wherein said bypass further comprises a bypass valve for regulating fluid communication between said outer portions of said upper chamber and said bypass chamber.

6. A fluid pump apparatus according to claim 4, wherein said bypass valve permits fluid passage when said fluid viscosity reaches a predetermined viscosity.

7. A fluid pump apparatus according to claim 4, wherein said upper chamber further comprises:

a first intermediate member disposed between said upper chamber and said bypass chamber, said first intermediate member having a first aperture therein for permitting fluid communication between said bypass chamber and said upper chamber, said first intermediate member also having a contact face positioned to sealingly engage an upper end of said primary filter; and a second intermediate member disposed between said upper chamber and said lower chamber, said second intermediate member having a second aperture therein for permitting fluid communication between said upper chamber and said lower chamber;

said second intermediate member having an annular flange extending upwardly into said upper chamber such that said primary filter sealingly engages said annular flange, thereby preventing passage of unfiltered fluid into said lower chamber.

8. A fluid pump apparatus for use in a motor vehicle, said fluid pump steering apparatus comprising:

a pump housing having a fluid outlet;

a reservoir attached to said pump housing, said reservoir having a lower chamber disposed adjacent to said housing, an upper chamber disposed above said lower chamber and including a fluid inlet and a bypass chamber disposed adjacent to said upper chamber;

filler means disposed on said reservoir above said upper chamber for filling said reservoir with a fluid;

a primary annular filter disposed within said upper chamber, said primary annular filter being operative to filter fluid flowing from said fluid inlet to said lower chamber; and a secondary annular filter disposed within said primary annular filter, said secondary annular filter being operative to filter all fluid flowing into said lower chamber.

9. A fluid pump apparatus according to claim 8, wherein said primary annular filter provides filtration of substantially finer particulate than said secondary filter.

10. A fluid pump apparatus according to claim 8, wherein said reservoir further comprises a bypass for communicating fluid from said inlet in said upper chamber into said bypass chamber without passing through said primary annular filter.

11. A fluid pump apparatus according to claim 10, wherein said bypass further comprises a bypass valve for regulating fluid communication between said outer portions of said upper chamber and said bypass chamber.

12. A fluid pump apparatus according to claim 11, wherein said bypass valve permits fluid passage when said fluid viscosity reaches a predetermined viscosity.

13. A fluid pump apparatus according to claim 8, wherein said upper chamber further comprises:

a first intermediate member disposed between said upper chamber and said bypass chamber, said first intermediate member having a first aperture therein for permitting fluid communication between said bypass chamber and said upper chamber, said first intermediate member also having a contact face positioned to sealingly engage an upper end of said primary annular filter; and a second intermediate member disposed between said upper chamber and said lower chamber, said second intermediate member having a second aperture therein for permitting fluid communication between said upper chamber and said lower chamber;

said second intermediate member having an annular flange extending upwardly into said upper chamber such that said primary annular filter sealingly engages said annular flange, thereby preventing passage of unfiltered fluid into said lower chamber.

14. A fluid pump apparatus for use in a motor vehicle, said fluid pump apparatus comprising:

a pump housing having a fluid outlet;

a reservoir attached to said pump housing, said reservoir having a lower chamber disposed adjacent to said housing, an upper chamber disposed above said lower chamber and including a fluid inlet and a bypass chamber disposed adjacent to said upper chamber;

filler means disposed on said reservoir above said upper chamber for filling said reservoir with a fluid;

a primary annular filter disposed within said upper chamber and defining therein an inner and outer portion of said upper chamber, sand primary annular filter being operative to filter fluid flowing from said fluid inlet to said lower chamber;

a bypass disposed between said outer portion of said upper chamber and said bypass chamber, said bypass being operative to communicate fluid from said upper chamber to said bypass chamber; and secondary annular filter disposed between said inner portion of said upper chamber and said lower chamber, said secondary annular filter being operative to filter all fluid flowing into said lower chamber.

15. A fluid pump apparatus according to claim 14, wherein said bypass further comprises a bypass valve for regulating fluid communication between said outer portions of said upper chamber and said bypass chamber.

16. A fluid pump apparatus according to claim 15, wherein said bypass valve permits fluid passage when said fluid attains a predetermined viscosity.

17. A fluid pump apparatus according to claim 14, wherein said primary annular filter provides filtration of substantially finer particulate than said secondary annular filter.

18. A fluid pump apparatus according to claim 14, wherein said upper chamber further comprises:

a first intermediate member disposed between said outer portion of said upper chamber and said bypass chamber, said first intermediate member having a first aperture therein for permitting fluid communication between said bypass chamber and said inner portion of said upper chamber, said first intermediate member further includes a contact face positioned to sealingly engage an upper end of said primary annular filter; and a second intermediate member disposed between said outer portion of said upper chamber and said lower chamber, said second intermediate member having a second aperture therein for permitting fluid communication between said inner portion of said upper chamber and said lower chamber;

said second intermediate member having an annular flange extending upwardly into said upper chamber such that said primary annular filter sealingly engages said annular flange, thereby preventing passage of unfiltered fluid into said lower chamber.

* * * * *